US009756962B2

(12) United States Patent
Perrin et al.

(10) Patent No.: US 9,756,962 B2
(45) Date of Patent: Sep. 12, 2017

(54) ACCESS-OPTIMIZED MOBILE INFANT SUPPORT

(71) Applicant: KIDS II, INC., Atlanta, GA (US)

(72) Inventors: Thomas M. Perrin, Alpharetta, GA (US); Stephen R. Burns, Cumming, GA (US)

(73) Assignee: KIDS II, INC., Atlanta, GA (US)

( * ) Notice: Subject to any disclaimer, the term of this patent is extended or adjusted under 35 U.S.C. 154(b) by 0 days.

(21) Appl. No.: 14/453,209

(22) Filed: Aug. 6, 2014

(65) Prior Publication Data

US 2015/0042130 A1 Feb. 12, 2015

Related U.S. Application Data

(60) Provisional application No. 61/864,156, filed on Aug. 9, 2013, provisional application No. 61/915,257, filed on Dec. 12, 2013.

(51) Int. Cl.

| | |
|---|---|
| ***A47B 39/00*** | (2006.01) |
| ***A47B 83/02*** | (2006.01) |
| ***A47D 1/00*** | (2006.01) |
| ***A47D 1/06*** | (2006.01) |
| ***A47D 15/00*** | (2006.01) |
| ***A47D 3/00*** | (2006.01) |
| ***A47D 5/00*** | (2006.01) |
| ***A47D 9/00*** | (2006.01) |
| ***A47D 9/02*** | (2006.01) |
| ***A47D 13/02*** | (2006.01) |
| ***A47D 13/10*** | (2006.01) |
| *A47D 1/04* | (2006.01) |

(52) U.S. Cl.

CPC ..... *A47D 1/006* (2013.01); *A47D 1/002* (2013.01); *A47D 1/004* (2013.01); *A47D 1/008* (2013.01); *A47D 1/06* (2013.01); *A47D 3/00* (2013.01); *A47D 5/00* (2013.01); *A47D 9/00* (2013.01); *A47D 9/02* (2013.01); *A47D 13/025* (2013.01); *A47D 13/10* (2013.01); *A47D 15/00* (2013.01); *A47D 1/04* (2013.01)

(58) Field of Classification Search

CPC ..... A47D 1/008; A47D 11/002; A47D 1/04; A47D 1/006; A47D 9/00; A47D 13/10; A47D 13/025; A47D 3/00; A47D 5/00; A47D 15/00; A47D 1/004; A47D 1/06

USPC ..... 297/135, 281, 130, 118, 148, 152, 153, 297/154, 250.1, 256.13, 256.26, 440.1, 297/344.12, 325, 183.6

See application file for complete search history.

(56) References Cited

U.S. PATENT DOCUMENTS

| | | | |
|---|---|---|---|
| 704,774 | A | 7/1902 | Blackledge |
| 3,110,519 | A | 11/1963 | Chernivsky |
| 3,556,587 | A | 1/1971 | Rymes |
| 3,653,080 | A | 4/1972 | Hafele |

(Continued)

*Primary Examiner* — Chi Q Nguyen

(74) *Attorney, Agent, or Firm* — Gardner Groff Greenwald & Villanueva, PC

(57) ABSTRACT

An access-optimized infant support device comprising a lower support frame and a seat or resting portion supported on the lower support frame, whereby the lower support frame maintains the seat or resting portion at a height allowing a line-of-sight eye-contact interaction between an infant on the seat or resting portion and an adult seated at a standard dining table, and also allows close proximity between the infant on the seat or resting portion and an adult seated on a standard sofa.

34 Claims, 5 Drawing Sheets

(56) References Cited

U.S. PATENT DOCUMENTS 3,759,539 A * 9/1973 Goldberg ..... 280/87.03
4,081,869 A 4/1978 Ash
4,141,095 A 2/1979 Adachi
4,188,678 A 2/1980 Rawolle
4,553,786 A 11/1985 Lockett, III et al.
4,946,180 A * 8/1990 Baer ..... 280/39
4,982,997 A 1/1991 Knoedler et al.
5,050,862 A * 9/1991 Saghafi ..... 482/68
5,052,749 A 10/1991 Groenendijk
5,172,955 A 12/1992 Freese et al.
5,178,438 A 1/1993 Beger
5,203,611 A 4/1993 Greenwood
5,207,478 A 5/1993 Freese et al.
5,238,292 A * 8/1993 Golenz ..... A47D 1/02 297/149
5,269,591 A 12/1993 Miga, Jr. et al.
5,308,143 A 5/1994 Cheng et al.
5,342,113 A 8/1994 Wu
5,360,258 A 11/1994 Alivizatos
5,364,137 A * 11/1994 Shimer ..... 297/327
5,451,095 A 9/1995 Riback
5,503,458 A 4/1996 Petrie
5,507,564 A 4/1996 Huang
5,527,096 A * 6/1996 Shimer ..... A47D 15/006 297/130
5,564,778 A * 10/1996 Shimer et al. ..... 297/130
5,575,530 A 11/1996 Harper et al.
5,615,428 A 4/1997 Li
5,762,310 A 6/1998 Schill
5,863,097 A 1/1999 Harper et al.
5,934,641 A 8/1999 Vince
6,089,653 A * 7/2000 Hotaling ..... A47D 1/002 297/130
6,290,290 B1 9/2001 Kokuzian et al.
6,341,816 B1 1/2002 Chen et al.
6,361,106 B1 3/2002 Huang
6,378,940 B1 4/2002 Longoria et al.
6,431,646 B1 8/2002 Longoria
6,547,195 B1 4/2003 Kokuzian et al.
6,574,806 B1 6/2003 Maher
6,588,033 B1 * 7/2003 Welsh, Jr. ..... A47D 7/002 5/93.1
6,594,840 B2 7/2003 Tomas et al.
6,616,237 B2 9/2003 Sonner et al.
6,645,080 B1 * 11/2003 Greger et al. ..... 472/118
6,682,148 B1 1/2004 Chen
6,739,649 B2 5/2004 Kelly et al.
6,877,802 B2 4/2005 Christensen et al.
6,951,371 B2 * 10/2005 Wang ..... 297/344.14
7,017,924 B1 * 3/2006 Lambert ..... 280/87.051
D560,374 S 1/2008 Bergkvist
7,326,120 B2 2/2008 Bellows et al.
7,555,791 B1 7/2009 Pereira
7,568,758 B2 * 8/2009 Troutman et al. ..... 297/148
7,624,954 B2 * 12/2009 Randle, Jr. ..... B60N 2/2848 248/129
7,694,362 B2 4/2010 Gudipati
7,695,374 B2 4/2010 Bellows et al.
7,779,490 B2 8/2010 Bergkvist
7,780,236 B2 8/2010 Bergkvist
7,862,118 B2 1/2011 Sims, Jr.
7,878,915 B2 * 2/2011 Myers et al. ..... 472/119
7,891,736 B2 2/2011 Sims, Jr.
7,896,431 B2 3/2011 Cui et al.
7,918,497 B2 * 4/2011 Keegan ..... 297/130
7,997,590 B2 * 8/2011 Walters ..... B60N 2/2848 248/423
8,011,722 B2 9/2011 Cui et al.
8,382,203 B2 2/2013 Gilbert et al.
8,419,132 B2 4/2013 Jacobs
8,544,949 B2 10/2013 Taton
D692,680 S 11/2013 Bergkvist et al.
8,690,245 B2 4/2014 Tuckey
8,740,306 B2 6/2014 Tuckey et al.
8,746,794 B2 6/2014 Oren et al.
8,757,716 B2 6/2014 Ru et al.
8,783,769 B2 7/2014 Gilbert et al.
8,845,028 B2 9/2014 Miller
8,893,326 B2 11/2014 Gooris
2003/0020317 A1 1/2003 Keegan et al.
2005/0054486 A1 3/2005 Turner et al.
2005/0241064 A1 * 11/2005 Lopes et al. ..... 5/93.1
2006/0181123 A1 8/2006 Gibree
2007/0007804 A1 1/2007 Pemberton et al.
2009/0200846 A1 8/2009 Yehuda
2011/0127810 A1 6/2011 Lee et al.
2011/0260507 A1 10/2011 Parness et al.
2012/0036635 A1 2/2012 Lapointe
2012/0169097 A1 7/2012 Mendes
2012/0261962 A1 10/2012 Huntsberger et al.
2013/0213159 A1 8/2013 Wu
2013/0285425 A1 10/2013 Chen
2013/0326817 A1 12/2013 Moulin
2014/0075671 A1 3/2014 Haut et al.
2014/0306498 A1 10/2014 Gilbert et al.
2014/0366276 A1 12/2014 Chang et al.

* cited by examiner

ACCESS-OPTIMIZED MOBILE INFANT SUPPORT

CROSS-REFERENCE TO RELATED APPLICATIONS

This application claims the benefit of U.S. Provisional Patent Application Ser. No. 61/864,156, filed Aug. 9, 2013, and U.S. Provisional Patent Application Ser. No. 61/915,257 filed Dec. 12, 2013, the entireties of which are hereby incorporated herein by reference for all purposes.

TECHNICAL FIELD

The present invention relates generally to the field of infant and child accessories, and more particularly to a mobile device for supporting and moving an infant or child, which is optimized for access to and interaction with the infant or child by a parent or caregiver.

BACKGROUND

Various accessories are used for supporting and transporting infants and children for different purposes. For example, a high-chair may be used for feeding or seating a child who can sit up, a bassinet or carrier may be used to support a laying or reclining infant or child, and a stroller may be used to transport a child from one location to another. None of these known accessories, however, allows optimal access to and interaction with an infant or child supported therein.

For example, a high-chair may not be well suited for a child who has not yet grown strong enough to sit up. High chairs also typically provide a seating height that is too high for interaction with the child by a caregiver seated on a sofa or other adult furniture. The mobility and maneuverability of high-chairs is typically limited at best. And the feeding tray, support frame and/or other components of a high-chair may interfere with positioning the infant or child in close proximity to a caregiver seated on a sofa or other adult furniture, and limit access to and interaction with the infant by the caregiver.

Conversely, the support height of known bassinets and carriers is commonly too low for ease of interaction with and access to the child by a caregiver seated on a sofa or other adult furniture, or when seated at a table for dining. The mobility and maneuverability of bassinets and carriers is also typically limited at best. And the support frame, carrier handles, and/or other components of a bassinet or carrier may interfere with positioning the infant or child in close proximity to a caregiver seated on a sofa or other adult furniture, and limit access to and interaction with the infant by the caregiver.

Strollers also typically position an infant or child too low for ease of interaction with and access to the child by a caregiver seated on a sofa or other adult furniture, or when seated at a table for dining. The mobility and maneuverability of strollers is typically best for outside use or use in open interior areas, but may not be good for moving an infant or child inside a home or other interior space where closely spaced furniture and narrow doorways and halls can interfere with movement and turning of a stroller. Stroller handles and support frames, large wheel assemblies, feeding trays and other components of a stroller may also interfere with positioning the infant or child in close proximity to a caregiver seated on a sofa or other adult furniture, and limit access to and interaction with the infant by a caregiver.

Accordingly, it has been discovered that needs exist for a mobile device for supporting and moving an infant or child, which is optimized for access to and interaction with the infant or child by a parent or caregiver, particularly for example, inside a home or other interior space. It is to the provision of a mobile device for supporting and moving an infant or child meeting these and other needs that the present invention is primarily directed.

SUMMARY

In example embodiments, the present invention provides a mobile device for supporting and moving an infant or child, which is optimized for access to and interaction with the infant or child by a parent or caregiver, particularly for example, inside a home or other interior space. The configuration of example embodiments of the support and transport device of the present invention allows parents or caregivers to position their infant or child in close proximity, for example when seated on a sofa, easy chair or other adult furniture, or when seated at a table for dining. The configuration of example embodiments of the support and transport device of the present invention also enables ease of mobility and maneuverability inside a home or other interior space where closely spaced furniture and narrow doorways can interfere with movement and turning of other devices.

In one aspect, the present invention relates to an access-optimized infant support device comprising a lower support frame and a seat or resting portion supported on the lower support frame, whereby the lower support frame maintains the seat or resting portion at a height of about 21" to about 36" above a support surface. In one aspect the seat or resting portion is maintained at a height of about 29".

In another aspect, the invention relates to an access-optimized infant support device comprising a lower support frame and a seat or resting portion supported on the lower support frame, wherein the seat or resting portion is oriented at an angle of inclination of about 15° to about 40°.

In still another aspect, the invention relates to an access-optimized infant support device comprising a lower support frame, a seat or resting portion supported on the lower support frame, and a gripping handle comprising a wrap-around halo grip substantially surrounding the seat or resting portion.

In another aspect, the invention relates to a mobile device for supporting and moving an infant or child including a seat portion and a support frame. The support frame supports the seat portion and includes one or more support legs and one or more cross-members extending between the support legs. The support legs generally extend from a proximal end near the seat portion to a distal end near a support surface or other ground surface that is supporting the frame. In one form, the distal ends of the support frame define a periphery including a width (W) and a length (L). In particular example embodiments, the width is between about 14" to about 23" and the length is between about 19" to about 31", and a length-to-width aspect ratio (L/W) is between about 0.8 to about 2.2.

In still another aspect, the invention relates to a mobile infant support device including a seat or resting portion for supporting a child or infant and a support frame for supporting the seat or resting portion about a support surface. In example forms, the support frame maintains the seat or resting portion at a height relative to the support surface such that a line-of-sight contact interaction between the infant on the seat or resting portion and an adult seated at a standard dining table or sofa can be easily maintained.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
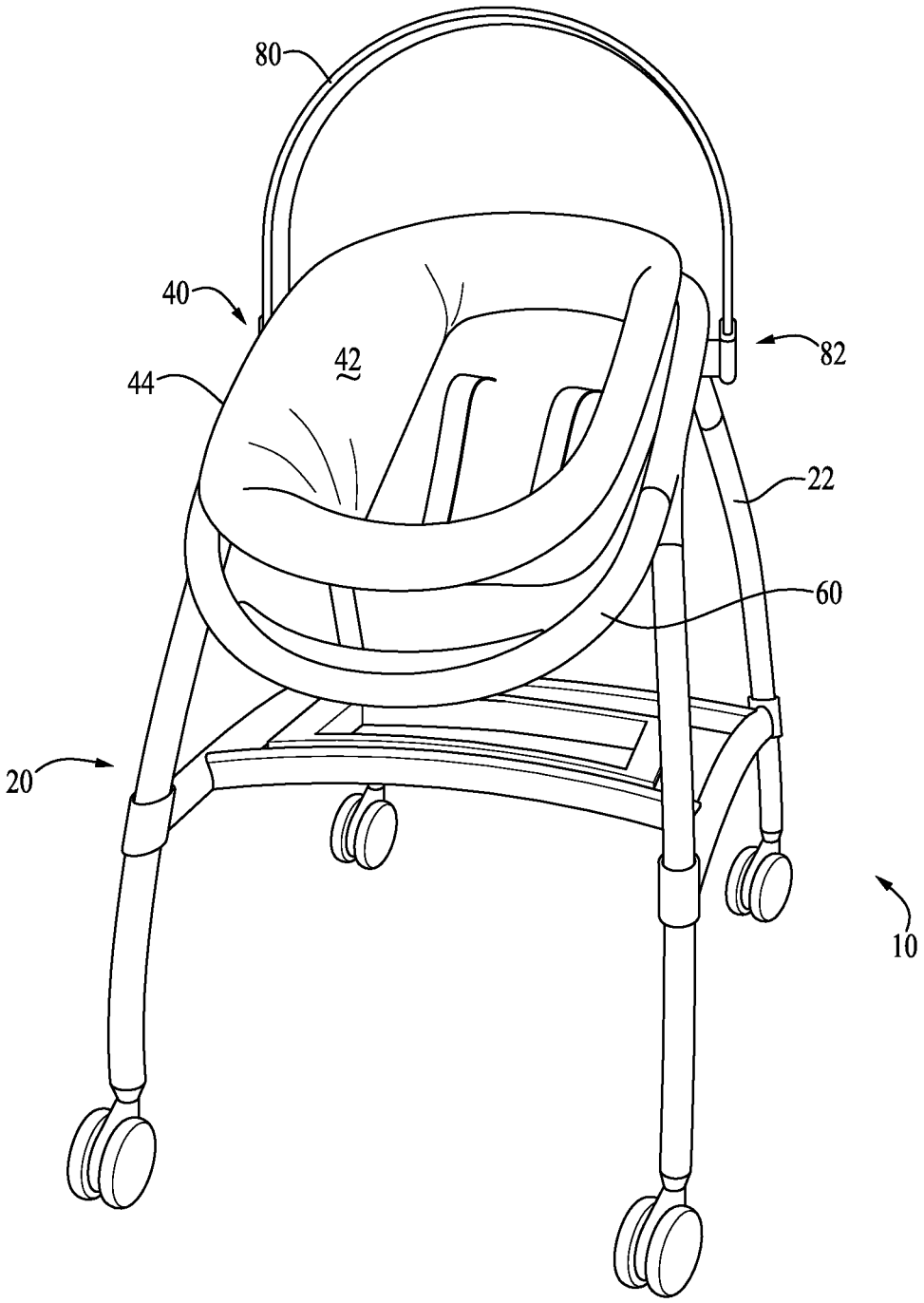
FIG. 1 is a front perspective view of a mobile device for supporting and moving an infant or child according to an example embodiment of the present invention.
Figure 2:
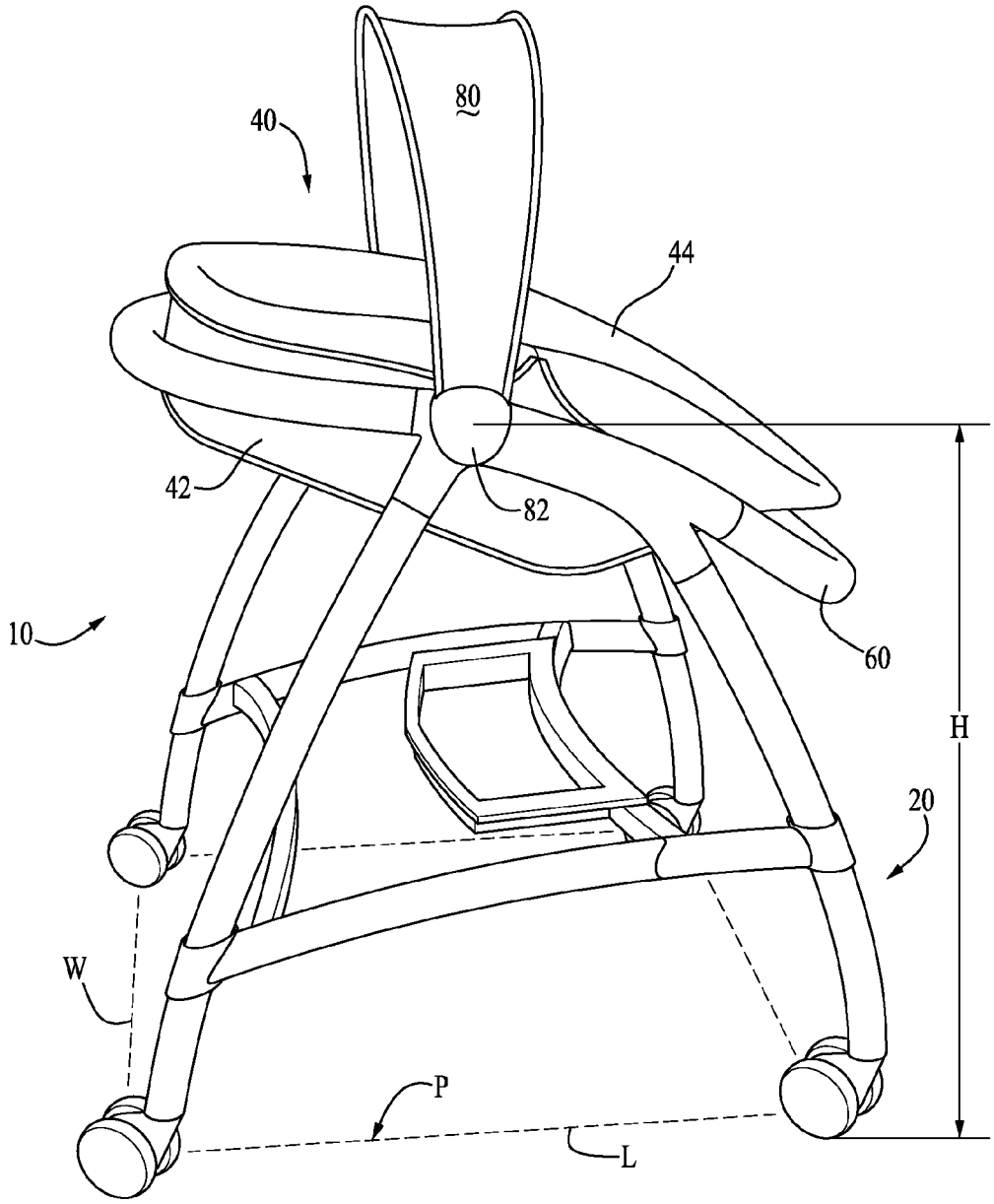
FIG. 2 is a side perspective view of the mobile device for supporting and moving an infant or child shown in FIG. 1.
Figure 3:
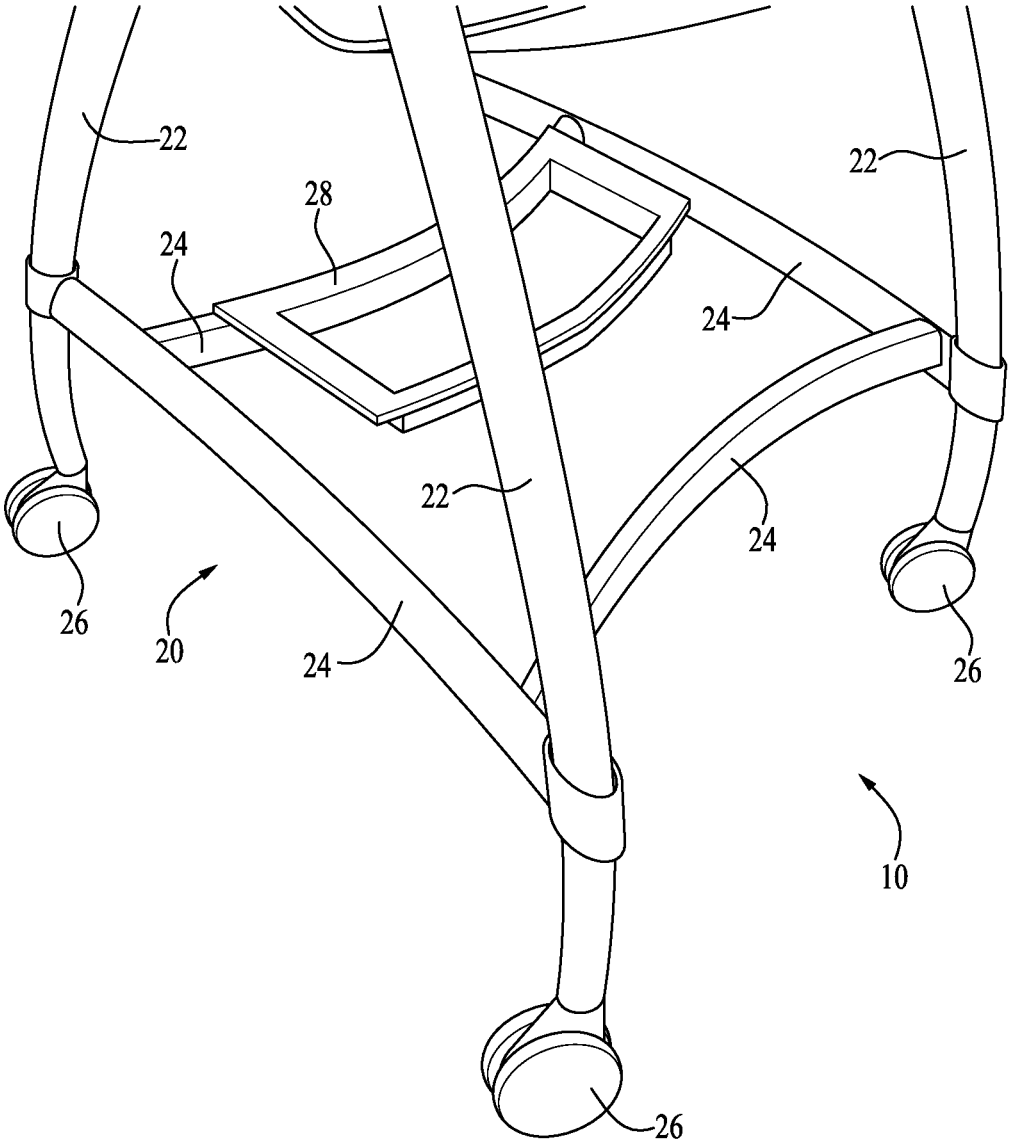
FIG. 3 is a detailed view of a lower support frame portion of the mobile device for supporting and moving an infant or child shown in FIG. 1.

With reference now to the drawing figures, wherein like reference numbers represent corresponding parts throughout the several views, FIGS. 1-3 show a mobile device 10 for supporting and moving an infant or child, according to an example embodiment of the invention. The device 10 generally comprises a support frame 20 and a seat or resting portion 40 supported on the support frame. The seat or resting portion 40 can be coupled directly to the support frame 20, or can be indirectly coupled to the frame by one or more intermediate couplings, linkages or connection members. Optionally, at least some degree of freedom of movement is provided between the seat or resting portion 40 and the support frame 20, for example allowing a rocking, jiggle, bounce, swing or other range of motion of the seat or resting portion relative to the support frame and underlying support surface. In example forms, the mobile support device is configured for use with zero to six month old infants, where access by, proximity to and interaction with a parent or other adult caregiver is most frequently needed, but in alternate forms may be adapted to other uses.

The support frame 20 preferably comprises one or more (four in the depicted embodiment) support legs or columns 22 for providing structural support to hold the seat or resting portion 40 at an elevation above the floor or other support surface. One or more cross-members or braces 24 extend between the legs 22 and/or between other braces. Wheels or rollers 26 mounted to distal or lower ends of the legs 22 allow for ease of mobility of the mobile support device 10 along the floor or other support surface. Optionally the wheels 26 comprise caster wheels or otherwise pivot or turn to provide ease of maneuverability. In example forms, the diameter of the wheels 26 is between about 2.5"-5", more preferably between about 3"-4", for example about 3.5". The frame 20 is optionally foldable or collapsible for compact storage and transport, for example by means of one or more hinged connections, pins, snap buttons, or other connection or coupling means. A storage tray 28 or other container or compartment for holding toys or other items is optionally mounted to a cross-member 24 or otherwise attached to the frame 20.

In example embodiments, the distal or lower ends of the legs 22 of the support frame 20 define an outline or periphery P along the floor or other support surface, as shown in broken lines in FIG. 2, within the upward projection of which the mobile support device 10 is substantially or entirely contained. In the depicted embodiment, the periphery P is generally rectangular or square in profile, being defined about four legs 22, but in alternate embodiments may be for example triangular, polygonal or circular in profile depending on the number and configuration of the legs of the support frame. In example embodiments, the periphery P is between about 14"-23" wide, preferably between about 16"-20" wide, and for example about 18" wide in width (W), by between about 19"-31", preferably between about 22"-28", and for example about 25" long in length (L), for example about 18"×25", defining a length-to-width aspect ratio (L/W) of between about 0.8-2.2, preferably between about 1.1-1.8, and for example about 1.4. Optionally, the legs 22 are generally arcuate, such that their lower or distal portions are more vertically oriented and their upper or proximal portions curve to a more horizontal or oblique angle, with the curvature being convex or outwardly directed. The cross-braces 24 are optionally inset from an upward projection of the periphery P, for example by providing them with an inward or concave curvature and/or by attachment inwardly of the support legs 22, as seen best with reference to FIG. 3. In this manner, the mobile support device 10 can be positioned in close proximity to a caregiver seated on furniture, without the support frame 20 interfering with movement and positioning of the device.

In example embodiments, the seat or resting portion 40 comprises a fabric or soft-goods sling 42, forming a reclined seat or bassinet for comfortably receiving an infant or child, mounted to a seat frame 44. The sling 42 optionally comprises structural bracing and/or padding for improved comfort and positioning. One or more straps or harness connections are optionally provided to secure the child in the sling 42. The sling 42 and/or the seat frame 44 are optionally repositionable to allow adjustment of the inclination, elevation or other positioning of the seat or resting portion 40, for example by means of a cinch cord or strap, snap couplings, pivotal connection, or other positional adjustment means. In example embodiments, the seat or resting portion 40 is positioned or positionable at an angle of inclination of between about 15°-40° from horizontal, for example about 27.5° relative to the horizontal.

The mobile support device 10 preferably further comprises a multi-point accessible handle 60 having a plurality of gripping or contact surfaces positioned at different points about the seat or resting portion 40. In example embodiments, the handle 60 provides access for gripping adjacent at least two of the head end, foot end, left side and/or right side of the seat or resting portion 40, and more preferably from three or all four sides thereof. In the depicted embodiment, the handle 60 comprises oval or elliptically shaped wrap-around or perimeter handle or gripping halo extending about all or a substantial portion of the seat or resting portion 40. In this manner, the handle can be gripped to push or pull the device 10 from any position for improved mobility and maneuverability. Provision of a wrap-around handle or halo as in the depicted embodiment allows the handle to serve the additional function of a protective bumper about the seat or resting portion 40 of the mobile support device 10. The handle 60 is preferably positioned adjacent or in close proximity below the upper rim of the seat or resting portion 40 formed by the seat frame 44, and closely or generally conforms to the peripheral profile of the seat frame. In example embodiments, the wrap-around handle 60 defines an upper support frame portion that generally aligns with the upward projection of the periphery P of the lower support frame 20. In alternate embodiments, the wrap-around handle 60 may be offset from the projection of periphery P of the lower support frame 20; either inwardly offset relative to the lower support frame for improved stability, or outwardly offset for improved access and proximity to the infant by an adult caregiver when the lower support frame is positioned against a sofa or other furniture.

In example embodiments, the handle 60 is coupled to the support frame 20, and the seat frame 44 is suspended from or otherwise coupled to the handle. A hinge connection, one or more springs, or other articulation means operably connected between the seat frame 44 and the handle 60 or the support frame 20 optionally allows movement of the seat or resting portion 40 relative to the support frame, for soothing or engaging an infant or child positioned in the mobile support device 10. In example embodiments, the seat 40 may jiggle, rock, swing, bounce or otherwise move. A motorized or manually energized movement mechanism is optionally provided. A pivotal coupling is optionally provided between the support frame 20 and the handle 60 to allow adjustment of the inclination of the seat 40. An upper member 80, such as a canopy, toy bar or handle is optionally attached over the seat 40, for example by pivotal or fixed attachment to a multi-connection hub or mounting member 82 coupling with the support frame 20 and/or the handle 60. Optionally, a vibration unit can be coupled to the support frame 20 or seat frame 44 for soothing the infant or child positioned in the mobile support device 10.

In example embodiments, the mobile support device is configured to position the infant or child at an elevation or height and/or at an orientation that is optimized for access, proximity and interaction with an adult caregiver in various situations, for example while the caregiver is standing, walking, seated at a table for dining, or seated in a sofa, easy chair or other adult furniture. For example, the nominal or median height (H) of the seat or resting portion 40 may be positioned at about 21"-36" above the floor, and more preferably at a height of about 26"-32", for example about 29" high; thereby, for example, defining a height-to-width (H/W) aspect ratio of between about 0.9-2.6, preferably between about 1.3-2.0, and for example about 1.6; and a length-to-width (L/W) aspect ratio of between about 0.8-2.2, preferably between about 1.1-1.8, and for example about 1.4. Optionally, the height of the seat or resting portion 40 may be adjustable. In example embodiments, the wrap-around handle 60 may be inclined at an oblique angle of for example about 15°-40°, for example about 27.5° relative to the horizontal or have a staggered profile along its length, whereby a lower portion at the foot end of the seat 40 is positioned lower than the nominal or median height (H) of the seat, thus providing a convenient gripping position for the caregiver when seated; and an upper portion at the head end of the seat is positioned higher than the nominal or median height, thus providing a convenient gripping position for the caregiver when standing or walking. In example embodiments, the elevation of the handle at the foot end is between about 13"-22" high, preferably between about 16"-19" in height, and for example about 17.5" above the floor; and the elevation of the handle at the head end is between about 22"-38" high, preferably between about 27"-33" in height, and for example about 30" above the floor. In this manner the height of the seat or resting portion allows a line-of-sight eye-contact interaction between an infant on the seat or resting portion and an adult seated at a standard dining table, and also allows close proximity between the infant on the seat or resting portion and an adult seated on a standard sofa. For example, the mobile support device may be positioned adjacent a standard sofa with the infant being within 12"-36", and preferably within 24" or less, from the adult; and/or the line of sight between the infant's eye-level and the adult's eye level is between about 0°-30°, preferably 15° or less, relative to horizontal, when the infant is positioned about 48"-60" from the adult at a dining table.

Figure 4A:
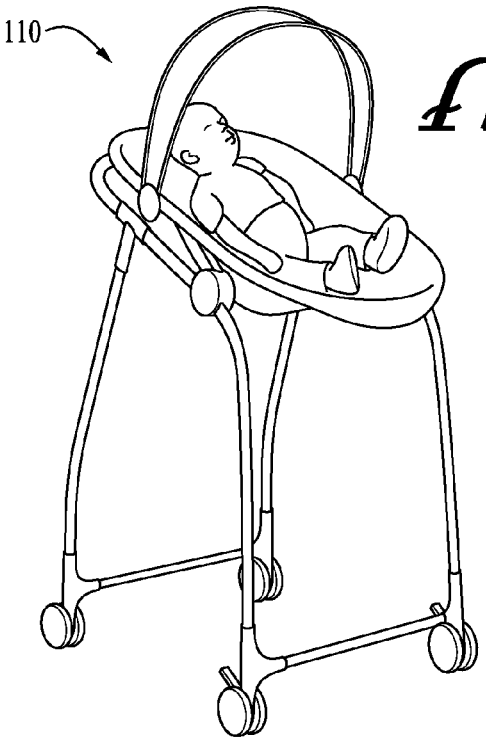
FIGS. 4A-4F show additional example embodiments of a mobile device for supporting and moving an infant or child according to the present invention.
Figure 4B:
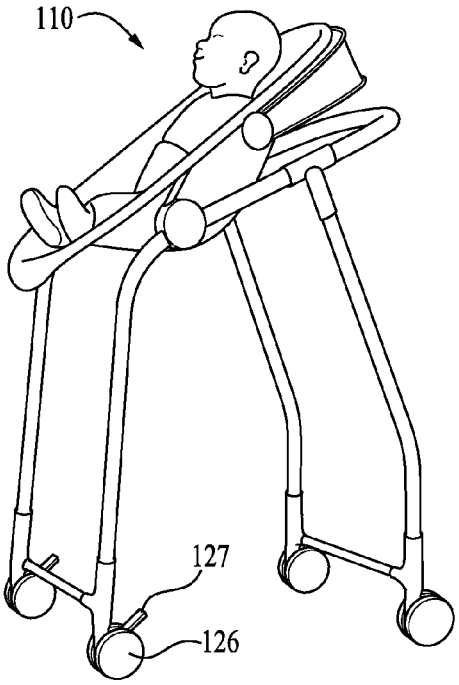
Figure 4C:
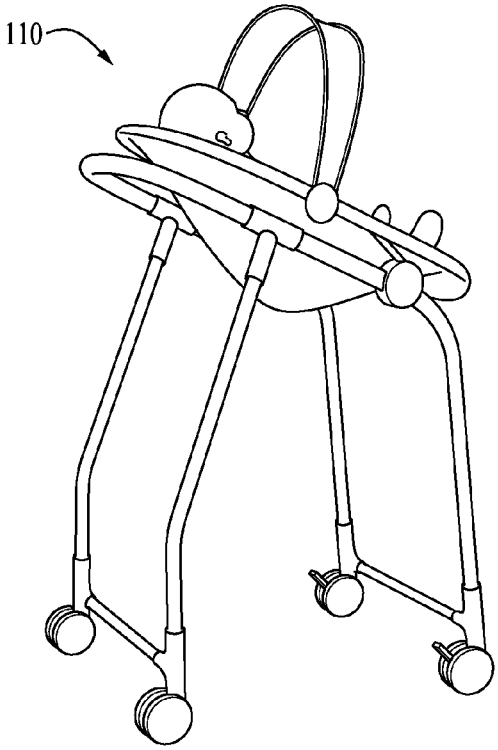
Figure 4D:
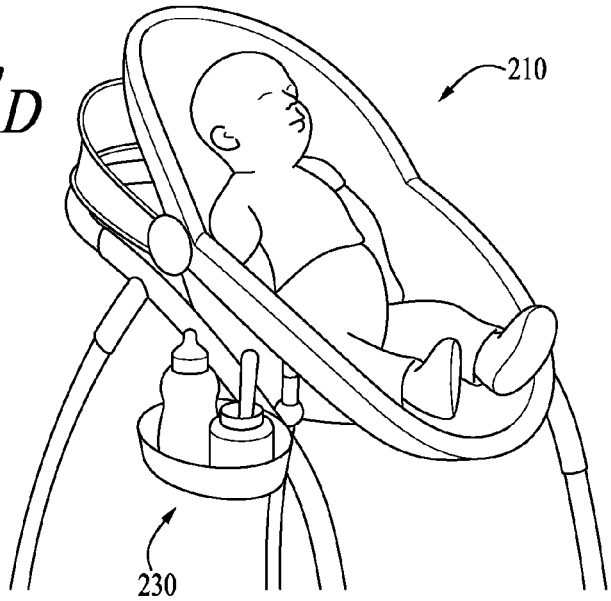
Figure 4E:
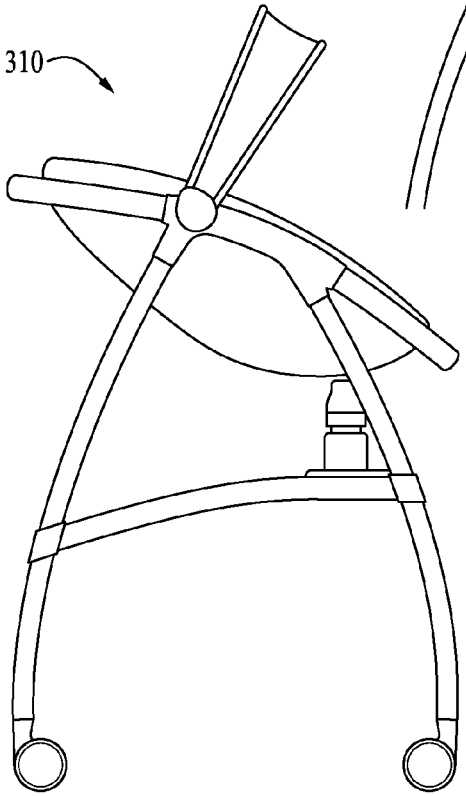
Figure 4F:
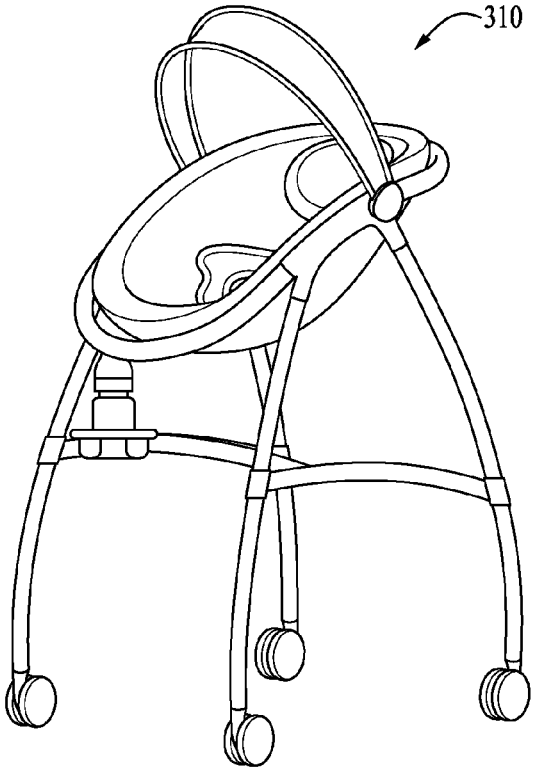

FIGS. 4A-4C show one alternate embodiment of a mobile support device 110, FIG. 4D shows another alternate embodiment of a mobile support device 210, and FIGS. 4E and 4F show still another alternate embodiment of a mobile support device 310, according to various forms of the invention. In its various forms, the child support device comprises a frame configured to rest on a support surface and a seat coupled to the frame and adapted for receiving an infant. Preferably, the support device includes one or more wheel assemblies, or other rolling/sliding means, which allow the support device to be rolled across the support surface. Example embodiments of the wheel assemblies can include a locking mechanism to selectively prohibit rolling of the child support device. The wheel assemblies can also or alternatively include a braking mechanism that engages in the event of accidental rolling. For example, one or more of the wheel assemblies 126 of the movable support device 110 can comprise a brake 127 for selectively engaging to prevent rotation of the wheel to resist movement of the device, or disengaging to release the wheel and allow movement of the device. A handle can also be included to facilitate a caregiver pushing or pulling the support device from room to room. Example embodiments of the handle are movable between various positions, such as above, behind, or in front of the seat. The seat can be coupled to the frame by way of one or more resilient members, such as springs or compliant wires that allow the seat to bounce or jiggle with respect to the frame. This bouncing motion can be soothing to children, and the resilient suspension can soften the jarring effect of any bumps as the support device is wheeled from place to place. Example embodiments of the seat can also be selectively reclined with respect to the support surface, either via adjustable soft-goods or by a mechanical recline adjustment mechanism. Moreover, various accessories can be attached to the child support device, such as a vibration unit, a tray, and/or a storage bin. The support device can further be configured to collapse for easy storage and transport.

In further alternate embodiments, the seat or resting portion is optionally detachable and removable from a coupling or receiver of the lower support frame. In this manner, the lower support frame can provide a docking station for one or more interchangeable seat, carrier, support, changing table or other accessories that can be selectively attached to and removed from the coupling of the lower support frame.

For improved mobility of the device and accessibility to the infant or child, example embodiments of the mobile support device according to the present invention do not include any feeding tray, push-handle or other components as are commonly included on high-chairs or strollers, or at least do not include such components in a position or configuration extending substantially beyond the upward projection of the periphery of the device's support frame where they could interfere with mobility, maneuverability, access, proximity or interaction with the infant. Optionally, as depicted in FIG. 4D, a tray 230 may project outwardly from the upper portion of the support frame 220 at least partially beyond the upward projection of the periphery of the support frame, but is preferably positioned so as not to interfere with mobility, maneuverability, access, proximity or interaction with the infant.

While the invention has been described with reference to preferred and example embodiments, it will be understood by those skilled in the art that a variety of modifications, additions and deletions are within the scope of the invention, as defined by the following claims.

What is claimed is:

1. An access-optimized infant support device comprising a lower support frame and a seat or resting portion supported on the lower support frame, whereby the lower support frame maintains the seat or resting portion at a height of about 21" to about 36" above a support surface and whereby the seat or resting portion is oriented at an angle of inclination of about 15° to about 40° relative to horizontal wherein the lower support frame comprises front and rear legs coupled to a gripping handle extending around at least a portion of the seat or resting portion.

2. The access-optimized infant support device of claim 1, wherein the lower support frame maintains the seat or resting portion at a height of about 26"-32".

3. The access-optimized infant support device of claim 1, wherein the lower support frame maintains the seat or resting portion at a height of about 29".

4. The access-optimized infant support device of claim 1, wherein the height of the seat or resting portion is adjustable.

5. The access-optimized infant support device of claim 1, wherein the lower support frame further comprises at least one wheel for mobility of the access-optimized infant support device.

6. The access-optimized infant support device of claim 1, wherein the seat or resting portion is oriented at an angle of inclination of about 27.5° relative to horizontal.

7. The access-optimized infant support device of claim 1, wherein the angle of inclination of the seat or resting portion is adjustable.

8. The access-optimized infant support device of claim 1, further comprising a detachable coupling between the lower support frame and the gripping handle allowing the seat or resting portion to be selectively attached to and removed from the lower support frame.

9. The access-optimized infant support device of claim 1, wherein the gripping handle is accessible at multiple locations around the seat or resting portion.

10. The access-optimized infant support device of claim 1, wherein the gripping handle is a wrap-around halo grip substantially surrounding the seat or resting portion.

11. The access-optimized infant support device of claim 1, wherein the lower support frame comprises a pair of front leg and a pair of rear legs.

12. The access-optimized infant support device of claim 11, wherein the lower support frame further comprises at least one cross-member extending between the legs.

13. The access-optimized infant support device of claim 12, wherein the legs define a periphery, and wherein the cross-member is inset a distance from a projection of the periphery.

14. The access-optimized infant support device of claim 11, wherein the legs define a periphery, and wherein the seat or resting portion substantially aligns with a projection of the periphery.

15. The access-optimized infant support device of claim 11, wherein the legs define a periphery, and wherein the seat or resting portion extends slightly beyond a projection of the periphery in at least one direction.

16. The access-optimized infant support device of claim 11, wherein the legs define a periphery, and wherein the seat or resting portion does not extend beyond a projection of the periphery.

17. The access-optimized infant support device of claim 11, wherein the legs define a periphery, and wherein the device does not include any stroller handle or feeding tray portion extending beyond a projection of the periphery.

18. The access-optimized infant support device of claim 1, wherein the height of the seat or resting portion allows a line-of-sight eye-contact interaction between an infant on the seat or resting portion and an adult seated at a standard dining table.

19. The access-optimized infant support device of claim 1, wherein the height of the seat or resting portion allows close proximity between an infant on the seat or resting portion and an adult seated on a standard sofa.

20. The access-optimized infant support device of claim 1, wherein the height of the seat or resting portion allows a line-of-sight eye-contact interaction between an infant on the seat or resting portion and an adult seated at a standard dining table, and also allows close proximity between the infant on the seat or resting portion and an adult seated on a standard sofa.

21. The access-optimized infant support device of claim 1, further comprising a connection allowing movement between the lower support frame and the seat or resting portion.

22. The access-optimized infant support device of claim 1, wherein the movement between the lower support frame and the seat or resting portion is soothing to an infant on the seat or resting portion.

23. The access-optimized infant support device of claim 1, wherein the movement between the lower support frame and the seat or resting portion is a jiggle movement.

24. A mobile device for supporting and moving an infant or child, comprising:

a seat portion having a gripping handle extending around at least a portion of the seat portion; and a support frame for supporting the seat portion, the support frame comprising support legs and cross-members extending between the support legs, the support legs extending from a proximal end near the seat portion to a distal end opposite the seat portion, wherein a plurality of the support legs are arcuate and define an outwardly directed convex curvature whereby their distal ends are more vertically oriented than their proximal ends and wherein the proximal ends of the support legs are coupled to the gripping handle;

wherein the distal ends of the support legs define a periphery comprising a width (W) and a length (L), the width being between about 14" to about 23" and the length being between about 19" to about 31", and wherein a length-to-width aspect ratio (L/W) is between about 0.8 to about 2.2.

25. The mobile device of claim 24, wherein the width is about 18".

26. The mobile device of claim 24, wherein the length is about 25".

27. The mobile device of claim 24, wherein the length-to-width aspect ratio is about 1.4.

28. The mobile device of claim 24, wherein the support frame maintains the seat portion at a height of about 21" to about 36" above the support surface.

29. The mobile device of claim 28, wherein the support frame maintains the seat portion at a height of about 29".

30. The mobile device of claim 24, wherein the gripping handle is accessible at multiple locations around the seat portion.

31. The mobile device of claim 24, wherein at least one of the cross-members is inset a distance from a projection of the periphery.

32. The mobile device of claim 24, wherein the seat portion substantially aligns with a projection of the periphery.

33. The mobile device of claim 24, further comprising at least one component including a feeding tray, push-handle or other accessory coupled to the seat portion and/or the support frame, wherein the at least one component does not substantially extend beyond a projection of the periphery.

34. A mobile infant support device comprising:

a resting portion for supporting a child or infant at an angle of inclination of about 15° to about 40° and a gripping handle extending at least partially around the resting portion;

a support frame for supporting the resting portion above a support surface the support frame comprising front and rear legs, wherein the gripping handle is coupled to the front and rear legs of the support frame, and, wherein the support frame maintains a head end of the resting portion at a height of about 22" to about 38" above the support surface such that a line-of-sight eye-contact interaction between the infant on the resting portion and an adult seated at a standard dining table or sofa can be easily maintained, and wherein a line of sight between the infant on the resting portion and the seated adult is at an angle of no more than about 30 degrees relative to horizontal when the support device is positioned no more than about 36 inches from the seated adult.

* * * * *